US006220289B1

(12) United States Patent
Zenker et al.

(10) Patent No.: US 6,220,289 B1
(45) Date of Patent: Apr. 24, 2001

(54) HYDRAULIC VALVE ARRANGEMENT WITH LOCKING AND FLOATING FUNCTION

(75) Inventors: Siegfried Zenker, Kirchseeon (DE); Carsten Christensen, Broager; Thorkild Christensen, Sønderborg, both of (DK)

(73) Assignee: Danfoss Fluid Power A/S, Nordborg (DK)

( * ) Notice: Subject to any disclaimer, the term of this patent is extended or adjusted under 35 U.S.C. 154(b) by 0 days.

(21) Appl. No.: 09/550,697

(22) Filed: Apr. 17, 2000

(30) Foreign Application Priority Data

Apr. 27, 1999 (DE) ..... 199 19 015

(51) Int. Cl.[7] ..... F15B 13/042
(52) U.S. Cl. ..... 137/596.2; 91/420; 91/447
(58) Field of Search ..... 91/420, 447; 137/596.2

(56) References Cited

U.S. PATENT DOCUMENTS 4,716,933 * 1/1988 Stoever et al. ..... 91/447
5,000,001 * 3/1991 Christensen et al. ..... 137/596
5,036,750 * 8/1991 Katayama ..... 137/596.2
5,211,196 * 5/1993 Schwelm ..... 91/420

* cited by examiner

*Primary Examiner*—Michael Buiz
*Assistant Examiner*—Ramesh Krishnamurthy
(74) *Attorney, Agent, or Firm*—Lee, Mann, Smith, McWilliams, Sweeney & Ohlson

(57) ABSTRACT

A hydraulic valve arrangement with locking and floating function, with a control valve (9), which, for two operating positions (11, 12) connects one motor connection (A) with a pump connection and a second motor connection (B) with a tank connection and vice versa, in a floating position (13) connects both motor connections (A, B) with the tank connection and in a locking position (10) separates both motor connections (A, B) from the pump and tank connections. Further, there are two closing valves (16, 17), each being connected between the control valve (9) and a motor connection (A, B) and each having a piston loaded by a spring and limiting a spring chamber, the spring chambers being pressure releasable. Characteristic of this valve arrangement is that lifting valves (18, 19) are provided for the pressure release, which valves are operated by a control pressure depending on the position of the control valve (9). This improves the operating reliability.

11 Claims, 3 Drawing Sheets

HYDRAULIC VALVE ARRANGEMENT WITH LOCKING AND FLOATING FUNCTION

Figure 1:
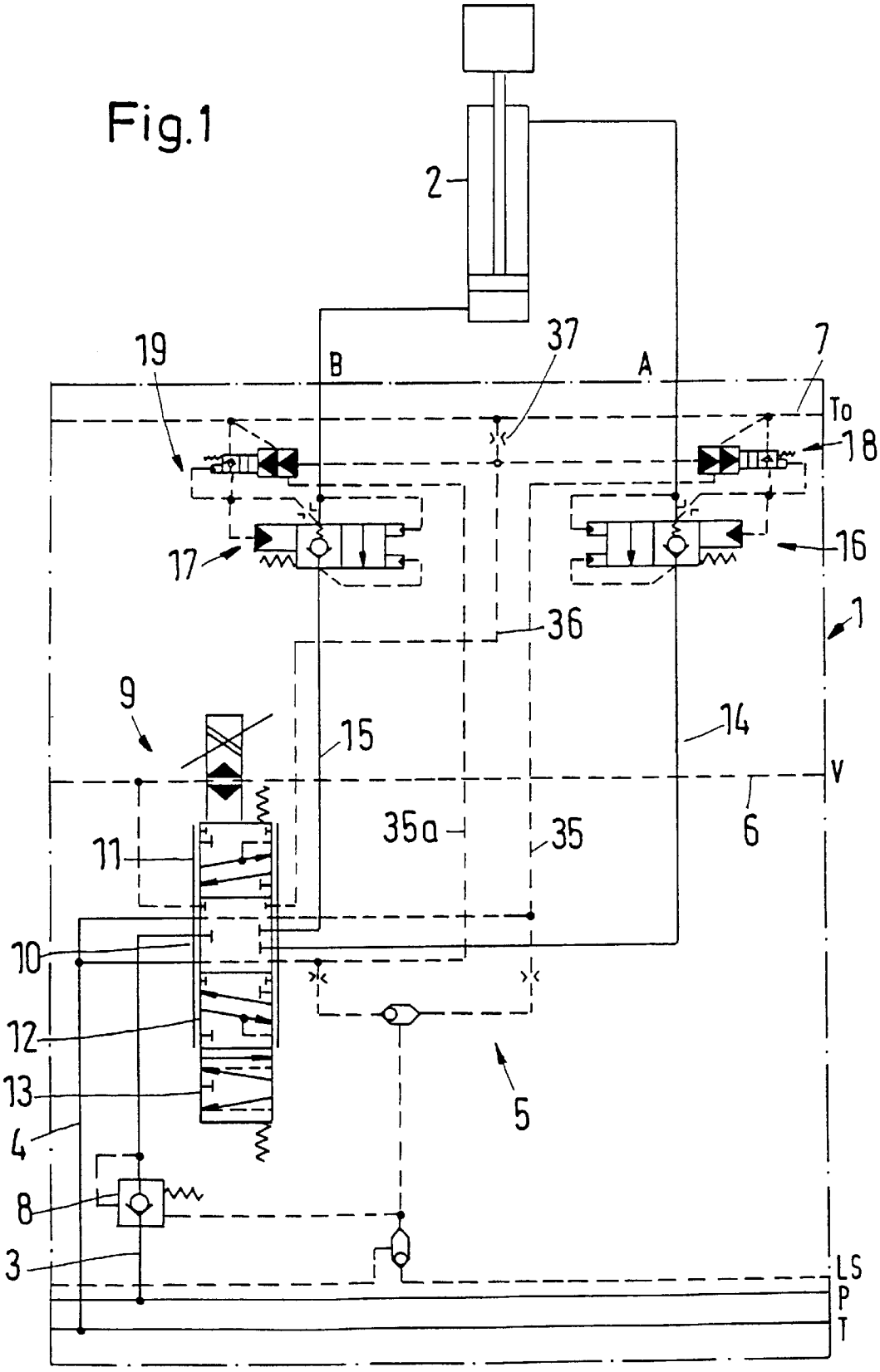

The invention concerns a hydraulic valve arrangement with locking and floating function, with a control valve, which, for two operating positions connects one motor connection with a pump connection and a second motor connection with a tank connection and vice versa, in a floating position connects both motor connections with the tank connection and in a locking position separates both motor connections from the pump and tank connections, and with two closing valves, each being connected between the control valve and a motor connection and each having a piston loaded by a spring and limiting a spring chamber, the spring chambers being pressure releasable.

Known hydraulic valve arrangements of this kind are mainly, but not exclusively, used in tractors, which can be provided with attachment tools, for example snow clearance or street cleaning vehicles. The pressure release of the spring chambers, which is required to keep the closing valves open in the operation positions and in the floating position of the control valve, occurs in that release channels open into the bore of the control valve and the opening is oversteered by its slide. However, sometimes it has turned out that errors occur in the function, particularly in the locking function.

The invention is based on the task of providing a hydraulic valve arrangement of the kind mentioned in the introduction, which has a better operating behaviour.

According to the invention, this task is solved in that lifting valves are provided for the pressure release, which valves are operated by a control pressure depending on the position of the control valve.

This design is based on the assumption that leakages are responsible for the failures, which leakages can never be completely avoided in slide controls. For high requirements, the invention provides the use of lifting valves for pressure release, which can without problems be dimensioned so that they are completely tight in closed position. The dependence of the valve operation of the position of the control valve is effected in that the lifting valves are operated by a position dependent control pressure. Both lifting valves are open in the floating position and closed in the locking position, whereas in the operating position one lifting valve or the other is open optionally. Therefore, corresponding control pressure levels can be provided, to which the lifting valves can be connected in dependence of the position of the control slide. An additional advantage is that leakage losses in connection with the pressure release are avoided.

In this connection, it has turned out to be advantageous that the lifting valves open at high control pressure and close at low control pressure. This gives a high certainty that the release process runs properly.

Expediently, pressures, which are available in the control valve anyway, are used as control pressure. Thus, the control pressure in the operating positions can be the load pressure. In the locking position the control pressure can be the tank pressure. And in the floating position the control pressure can be a floating signal pressure or the pump pressure.

With regard to design it is recommended that the lifting valves have a closure piece which is pressed against its valve seat by means of a spring, and a piston acting upon the closure piece in the opening direction, which piston is loaded by the control pressure in the opening direction and by the tank pressure and a spring in the closing direction. Such a valve is normally closed and opens when a sufficiently high control pressure appears.

In a further embodiment of the invention it is provided that the pistons of each pair are arranged in series two and two, and in the operating position the control pressure is led to a control pressure chamber between the pistons, in the floating position commonly to control pressure chambers at the ends of both pairs. In the operating position, therefore, one of the two pistons facing the closure piece is operated, in the floating position, however, both pistons of each pair are displaced.

In this connection it is recommended that the control pressure line leading to the control pressure chambers at the ends of both pairs be connected via a throttle with a low-pressure line carrying low pressure. The pressure building up in the piston operating chambers in the locking position can therefore be dissipated via the line carrying low pressure (or tank pressure).

A preferred alternative provides that in each case one piston with a control pressure chamber is available, to which, in the operating position, the control pressure is led separately, in the floating position via a closing valve, from a common control pressure line. For each lifting valve one piston will be sufficient, which saves costs.

Besides, it is expedient that the control pressure line carrying load pressure in the operating position is con nected to a low pressure in the locking position. One and the same control pressure line can here be used for two operating positions. A normal control valve can be used. Further, automatic pressure dissipation occurs, when the control pressure line is connected with the low pressure.

Figure 2:
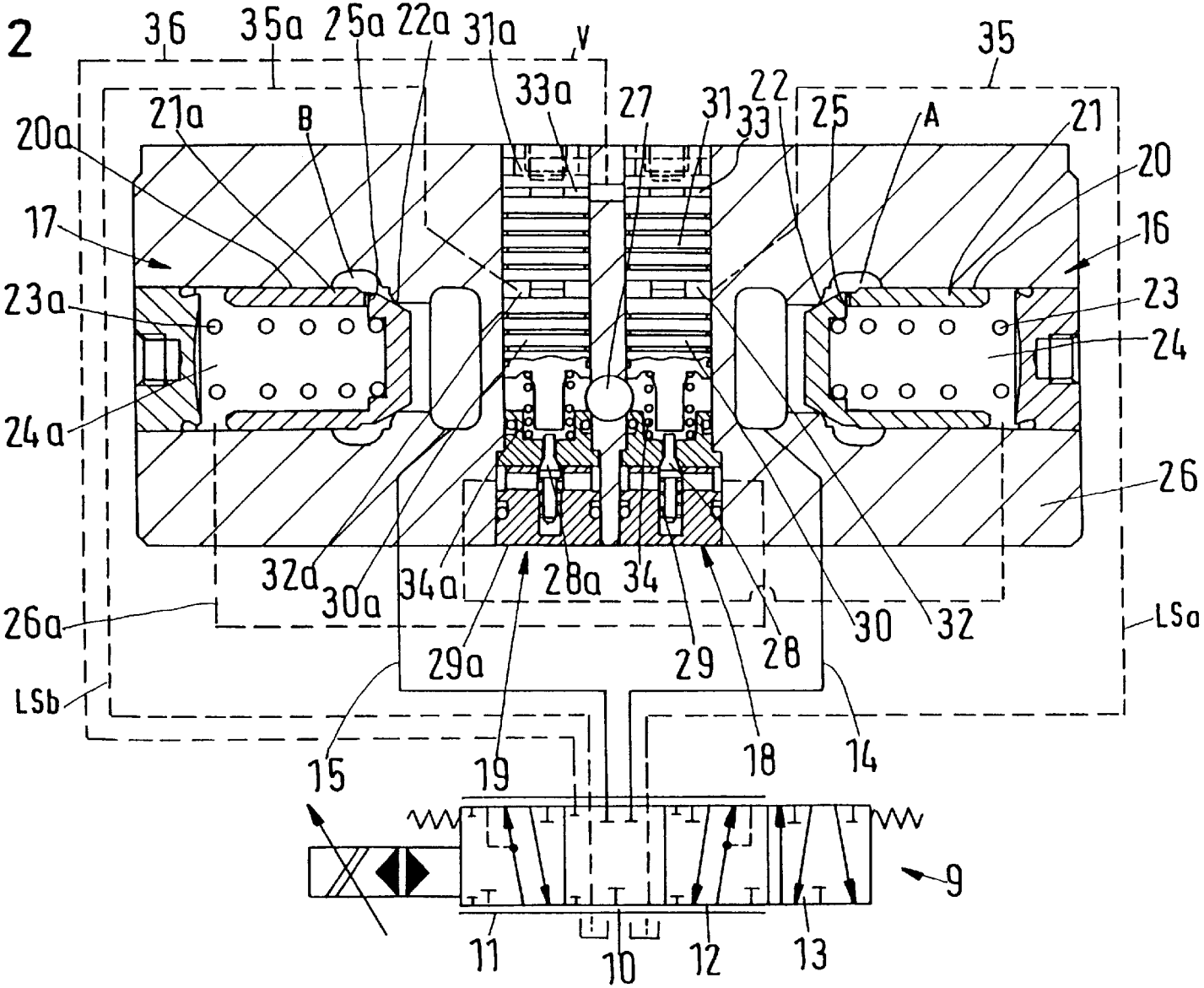

In the following the invention is described in detail on the basis of two embodiments shown in the drawings, showing:

FIG. 1 a diagram of a first embodiment of the valve arrangement according to the invention FIG. 2 details of the valve arrangement in FIG. 1

Figure 3:
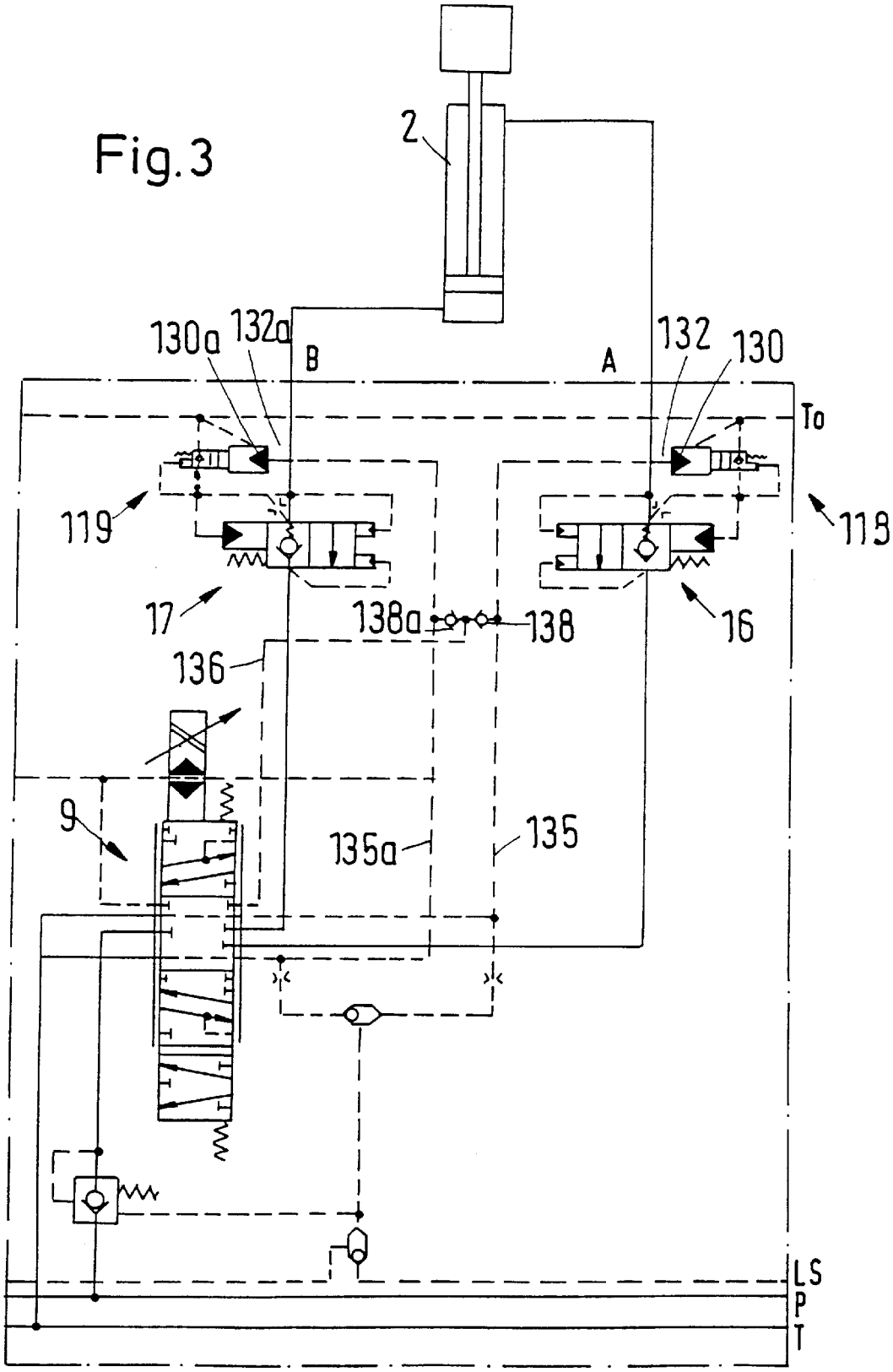

FIG. 3 a diagram according to FIG. 1 of a modified embodiment

FIG. 1 shows a module 1, which serves the operation of a motor 2. Its dimensions and embodiment are substantially equal to usual designs. The module 1 has a connection carrying pump pressure P and being connected with a pump line 3, a connection carrying tank pressure T and being connected with a tank line 4, a connection carrying load pressure LS and being connected with a load pressure system 5, a connection carrying floating signal pressure V and being connected with a signal line 6, a connection carrying low pressure To and being connected with a low pressure line 7, as well as two motor connections A and B serving as connections for the motor 2.

The pump line 3 leads via a load pressure steered compensating valve 8 to a control valve 9, which is made as a slide valve and can assume a locking position 10, two operating positions 11 and 12 as well as a floating position 13. The control valve 9 operates two motor lines 14 and 15, which lead to the motor connection A or B, respectively, via a closing valve 16 or 17, respectively. For pressure release, each closing valve has a lifting valve 18 or 19, respectively, which will be described in detail in connection with FIG. 2.

Each closing valve 16 or 17, respectively, has a piston 21, guided in a housing bore 20, the front side of said piston cooperating with a valve seat 22, being loaded by a closing spring 23 and limiting a spring chamber 24. The spring chamber 24 is connected via a throttle 25 with the second part of the motor line 14 leading to the motor connection A and via a release line 26 and the lifting valve 19 with a line 27 leading to the tank line 4. The diameter of the valve seat 22 is so much smaller than the outer diameter of the piston 21 that, in case of pressure substantially inside the seat the closing valve can open the spring chamber 24 without pressure release, in case of pressure substantially outside the seat the closing valve can only open the spring chamber 24 with pressure release. The closing valve 17 has the same design; therefore the same reference signs, although with the addition "a", are used. Here, the release of the spring chamber 24*a* occurs via the release line 26*a* and the lifting valve 18 to the line 27 carrying tank pressure.

With the lifting valve 18, its closure piece 28 is pressed into a tight closing position by means of a spring 29. For the opening of the lifting valve, two pistons 30 and 31 are provided, which limit a first control pressure chamber 32 between them and at the end have a second control pressure chamber 33. In the opening direction, the pistons are loaded by a return spring 34 and the tank pressure T. The lifting valve 19 has the same design, therefore also here the same reference signs with the addition "a" are used.

The control pressure chamber 32 is connected with a first control pressure line 35 and the control pressure chamber 32*a* with a second control pressure line 35*a*. The two control pressure chambers 33 and 33*a* are both connected to a control pressure line 36. In the locking position 10 the control pressure lines 35 and 35*a* are connected with the tank line 4 and in the operating positions 11 and 12 they carry the correspondingly effective load pressure, LSa or LSb, respectively. In the floating position 13, the control pressure line 36 is loaded by the floating signal pressure V, which can be equal to an otherwise available pilot pressure or the pump pressure, which is entered via the signal line 6.

As the control pressure lines 35 and 35*a* carrying the load pressure in the operating positions are connected with the tank in the neutral position, an automatic release of the control pressure chambers 32 and 32*a* occurs. These connections require no particular efforts, as they are already available for other reasons. Thus, a pressure build-up in the lifting valves 18 and 19 is out of the question. Accordingly, the two closing valves 16 and 17 cannot open unwantedly.

Between the control pressure line 26 and the low-pressure line 7 a throttle 37 is provided, which serves the pressure build-up in the control pressure chambers 33 and 33*a*. The low pressure To can be equal to the tank pressure T or a low pressure having a preferably constant level and being independent of the tank pressure.

This gives the following modes of operation:

1. Locking Function

The control valve 9 assumes the position 10 shown, which corresponds to the neutral position. Both control pressure lines 35 and 35*a* are connected with the tank line 4. The control pressure chambers 32 and 32*a* are under tank pressure T, and due to the pressure dissipation at the throttle 37, the control pressure line 36 also carries no pressure. Both lifting valves 18 and 19 are therefore closed. Also the motor lines 14 and 15 are separated from the pump line 3. The motor 2 has a fixed position. As the lifting valves 18 and 19 are closing tightly, there is also no risk that a change of the pressure conditions, such as a negative load at the motor 2, will cause a closing valve to open.

2. Operating Function

This corresponds to the position 11 or 12 of the control valve 9. In the operating position 11, the supplied pressure fluid presses the closing valve 17 open. At the same time, the lifting valve 19 is opened, as load pressure is supplied via the control pressure line 35*a*. Accordingly, the spring chamber 24 of the closing valve 16 is pressure released. Thus, the closing valve 16 can also open under the influence of the returning pressure fluid. Similar conditions apply for the operating position 12.

3. Floating Function

In the floating position 13, the control pressure line 36 is provided with the floating signal pressure V, which is supplied via the signal line 6. This opens both lifting valves 18 and 19. Both spring chambers 24 and 24*a* are released. Small pressure increases on one of the motor connections A or B are sufficient to open the closing valves 16, 17. Thus the motor can adjust freely in dependence of its outer loads. The springs 29, 29*a* and 34, 34*a* can be dimensioned with such a preload that at the end of a floating function the closure pieces return safely into their closing position.

The alternative according to FIG. 3 substantially corresponds to FIG. 1. For changed parts, reference numbers increased by 100 are used. Substantially, merely the two lifting valves 118 and 119 and the corresponding control pressure supply are different. The two lifting valves 118 and 119 merely have one piston with a pressure chamber 132 or 132*a*, respectively, which are supplied by the control pressure line 135 or 135*a*, respectively. The common control pressure line 136 is connected with the control pressure chambers 132 or 132*a*, respectively, via two closing valves 138, 138*a*. Thus, the floating signal pressure is supplied to both control pressure chambers at the same time. Special measures for the pressure dissipation are not required, as it takes place automatically via the control pressure lines 135, 135*a*, when the neutral position of the control valve is passed.

The lifting valves 18 and 19 need no fixed allocation to the control valve 9 and to the closing valves 16 and 17. They can therefore be arranged in the valve housing where this is favourable for space reasons or because of the short connecting channels. Therefore, the lifting valves can also be separated from each other and be arranged in another level than the closing valves.

Several deviations from the embodiments shown are possible, without leaving the basic idea of the invention. Thus, for example, the release of the control pressure lines 35, 35*a*, 135 and 135*a* in the locking position 10 take place to the constant low pressure to in stead of the tank pressure t, so that a pressure increase in the tank has no influence on the lifting valve control.

What is claimed is:

1. Hydraulic valve arrangement with locking and floating functions, and including a control valve having two operating positions, one operating position which connects one motor connection with a pump connection and a second motor connection with a tank connection and a second operating position which connects vice versa, the control valve having a floating position which connects both motor connections with the tank connection and the control valve having a locking position which separates both motor connections from the pump and tank connections, and further including two closing valves, each being connected between the control valve and a motor connection and each having a piston loaded by a spring located in a spring chamber, the spring chambers being pressure releasable, and including lifting valves for pressure release, the lifting valves being operated by a control pressure depending on the position of the control valve.

2. Valve arrangement according to claim 1, in which the lifting valves open at high control pressure and close at low control pressure.

3. Valve arrangement according to claim 1, in which the control pressure in the two operating positions is load pressure.

4. Valve arrangement according to claim 1, in which in the locking position the control pressure is tank pressure.

5. Valve arrangement according to claim 1, in which in the floating position the control pressure is a floating signal pressure.

6. Valve arrangement according to claim 1, in which in the floating position the control pressure is pump pressure.

7. Valve arrangement according to claim 1, in which the lifting valves have a closure piece which is pressed against its valve seat by means of a spring, and a piston acting upon the closure piece in an opening direction, which piston is loaded by the control pressure in the opening direction and by the tank pressure and a spring in a closing direction.

8. Valve arrangement according to claim 7, in which the piston of each lifting valve comprises a pair of pistons arranged in series, and in the operating position the control pressure is connected to a first control pressure chamber between the pair of pistons, and in the floating position control pressure is connected to a second control pressure chamber at one end of the pair of pistons.

9. Valve arrangement according to claim 8, in which the control pressure line leading to the second control pressure chamber at the end of each pair of pistons is connected via a throttle with a low pressure line carrying low pressure.

10. Valve arrangement according to claim 7, in which the piston is connected to a control pressure chamber, to which, in the two operating positions, the control pressure is led separately, and in the floating position the control pressure is led via a closing valve, from a common control pressure line.

11. Valve arrangement according to claim 5, in which the control pressure line carrying load pressure in the operating position is connected to a low pressure in the locking position.

* * * * *